US008310377B2

(12) United States Patent
Sirota et al.

(10) Patent No.: US 8,310,377 B2
(45) Date of Patent: Nov. 13, 2012

(54) MOBILE AUTOMATED SYSTEM FOR TRAFFIC MONITORING

(75) Inventors: Jacobo Marcos Sirota, Takoma Park, MD (US); Jose Patricio Tillard, Greenbelt, MD (US); David Keshvar Mostofi, Chevy Chase, MD (US); Donald Mitchell Cornwell, Jr., Highland, MD (US); Miodrag Cekic, Bethesda, MD (US)

(73) Assignee: Optotraffic, LLC, Lannam, MD (US)

( * ) Notice: Subject to any disclaimer, the term of this patent is extended or adjusted under 35 U.S.C. 154(b) by 589 days.

(21) Appl. No.: 12/546,043

(22) Filed: Aug. 24, 2009

(65) Prior Publication Data

US 2011/0043381 A1 Feb. 24, 2011

(51) Int. Cl.
*G08G 1/017* (2006.01)
*G08G 1/054* (2006.01)

(52) U.S. Cl. ..... 340/937; 340/905; 340/907; 701/117; 701/119; 348/143; 348/148; 348/149

(58) Field of Classification Search ..... 340/937, 340/905, 907; 701/117, 119; 348/143, 148, 348/149

See application file for complete search history.

(56) References Cited

U.S. PATENT DOCUMENTS

| | | | | |
|---|---|---|---|---|
| 5,515,042 | A * | 5/1996 | Nelson | 340/937 |
| 5,809,161 | A * | 9/1998 | Auty et al. | 382/104 |
| 5,896,190 | A | 4/1999 | Wangler et al. | |
| 5,912,822 | A | 6/1999 | Davis et al. | |
| 5,935,190 | A | 8/1999 | Davis et al. | |
| 5,948,038 | A | 9/1999 | Daly et al. | |
| 6,111,523 | A | 8/2000 | Mee | |
| 6,373,402 | B1 | 4/2002 | Mee | |
| 6,466,260 | B1 * | 10/2002 | Hatae et al. | 348/149 |
| 6,546,119 | B2 | 4/2003 | Ciolli et al. | |
| 6,919,823 | B1 | 7/2005 | Lock | |
| 7,986,339 | B2 * | 7/2011 | Higgins | 348/149 |
| 2002/0063858 | A1 | 5/2002 | Patterson | |
| 2003/0025791 | A1 * | 2/2003 | Kaylor et al. | 348/143 |
| 2003/0214585 | A1 * | 11/2003 | Bakewell | 348/148 |
| 2005/0179539 | A1 * | 8/2005 | Hill et al. | 340/539.1 |
| 2005/0197976 | A1 | 9/2005 | Tuton et al. | |
| 2006/0017809 | A1 * | 1/2006 | Carroll | 348/158 |
| 2006/0269104 | A1 * | 11/2006 | Ciolli | 382/104 |
| 2007/0185689 | A1 * | 8/2007 | Muraski et al. | 702/187 |
| 2010/0271497 | A1 * | 10/2010 | Monsive, Jr. | 348/211.99 |

OTHER PUBLICATIONS

U.S. Appl. No. 61/173,467, Monsive, JR, Portable Traffic Monitoring System, Apr. 28, 2009, paragraphs 15, 16, 23, 25.*

* cited by examiner

*Primary Examiner* — George Bugg
*Assistant Examiner* — Anne Lai
(74) *Attorney, Agent, or Firm* — Miodrag Cekic

(57) ABSTRACT

An autonomous system for automated monitoring of traffic patterns on at least one designated surface including at least one mobile monitoring and recording module. The at least one mobile monitoring and recording module includes at least one support and stabilization section, at least one erector section, at least one autonomous source of electric energy, at least one electric energy storage device, and at least one control and information storage unit. The at least one support and stabilization section incorporates a transportation subsection arranged to provide mobility when coupled to a source of a mechanical force and at least one stabilizing subsection arranged to stabilize the at least one mobile monitoring and recording module in a stationary traffic monitoring position. The at least one erector section includes an erector arranged to erect at least one speed measuring device, at least one traffic imaging device, and at least one illumination device at respective predetermined heights above the designated surface.

38 Claims, 5 Drawing Sheets

MOBILE AUTOMATED SYSTEM FOR TRAFFIC MONITORING

CROSS REFERENCE TO RELATED APPLICATIONS

This application is based upon and claims benefits of copendng and co-owned U.S. patent application Ser. No. 11/118,540 entitled "SYSTEM AND METHOD FOR TRAFFIC MONITORING, SPEED DETERMINATION, AND TRAFFIC LIGHT VIOLATION DETECTION AND RECORDING" filed with the U.S. Patent and Trademark Office on Apr. 29, 2005, which is incorporated herein by reference.

FIELD OF THE INVENTION

This invention relates to a system for monitoring traffic patterns, speed measuring, and red light enforcement on at least one designated surface supporting traffic. More particularly, the invention relates to an autonomous automated mobile system capable of monitoring multi-lane traffic and recording traffic violations related to red light signals and speed limits.

BACKGROUND OF THE INVENTION

A system for traffic monitoring, vehicle speed determination and traffic light violation detection and recording is disclosed. In one embodiment of the current invention, the system is arranged for monitoring traffic supported by a designated surface of a roadway, detecting individual vehicles, measuring vehicle speeds, identifying potential traffic violators, and triggering a traffic imaging device such as a camera or a video system. Different embodiments of the system can also be used by law enforcement agencies and research groups for other applications such as measurement of traffic density, monitoring vehicle speed, and studying traffic patterns. One application of particular embodiments of the current invention is to enforce red light violations. The systems of those embodiments rely on eye-safe laser radiation and scattering of such radiation off the road surface to determine the presence of a vehicle, calculate its speed, determine when a violation is likely to occur (based on predetermined criteria), and trigger the traffic imaging device for collecting evidence of the violation.

Installing traffic monitoring and photo-enforcement systems of prior art customarily involves digging traffic surfaces and pavements in order to install cables for interfacing the violation detecting/recording system with the traffic control devices for synchronization. Such an arrangement, for example, can make a prior art red light photo-enforcement system at least a semi-permanent installation for a specific approach at an intersection. In contrast, the disclosed exemplary embodiments of the current invention do not have a wired connection between a traffic light controller and a system for traffic monitoring in order to communicate the status of the traffic light signal. In some embodiments of the current invention, the state of the traffic signal can be determined remotely by using an optical system coupled to individual detectors or a CCD (charge-coupled device) image recorder as a remote traffic light sensor.

The disclosed embodiments of the system for automated monitoring of traffic patterns, speed measuring, and red light enforcement eliminates the installation costs associated with interfacing by hard wiring the traffic signal controller with conventional Red Light Camera applications. In conjunction with non-intrusive speed quantification technologies (such as laser or video speed sensors), pertinent embodiments of the disclosed systems for monitoring of traffic patterns in accordance with the current invention make it possible to implement an automatic, fully transportable, and autonomous solution. This may be a significant feature for municipalities and police departments who may not decide to install permanent and hard-wired photo-enforcement systems.

Another embodiment of the system according to the current invention includes a mobile monitoring and recording module that can operate in residential areas without disturbing nearby residents or traffic participants. The system module of this embodiment may integrate a lane-specific, laser-based speed measurement device where the laser beams are arranged to impact elongated strips orthogonal to the direction of traffic, detect traffic participants intercepting the elongated strips and determine speeds of the traffic participants having no need to continuously correct the determined speed in accordance to angular relationship between the measuring device and the target traffic participants ("cosine corrections" known in prior art). If any of the traffic participants exceeds and violates a predetermined speed limit, a high-speed visible/infrared (IR) digital camera and an IR flash illuminator are arranged to record images of the violating traffic participant to allow generation of citations both day and night. All sensors of those embodiments may be mounted, for example, on a single erector section, which, in turn, allows the system to be mounted on a wheeled trailer arranged to support and transport the erector section. An exemplary system of this embodiment may be powered by a hybrid electric battery/quiet diesel generator system and requires no hard-wired connections to the local utility infrastructure.

SUMMARY OF THE INVENTION

One embodiment of the current invention is directed to autonomous systems for automated monitoring of traffic patterns on at least one designated surface including at least one mobile monitoring and recording module. The at least one mobile monitoring and recording module includes at least one support and stabilization section, at least one erector section, at least one autonomous source of electric energy, at least one electric energy storage device, and at least one control and information storage unit. The at least one support and stabilization section incorporates a transportation subsection arranged to provide mobility when coupled to a source of a mechanical force and at least one stabilizing subsection arranged to stabilize the at least one mobile monitoring and recording module in a stationary traffic monitoring position. The at least one erector section includes an erector arranged to erect at least one speed measuring device, at least one traffic imaging device, and at least one illumination device at respective predetermined heights above the designated surface.

Another embodiment of the current invention pertains to autonomous systems for automated monitoring of traffic patterns, speed measuring, and red light enforcement on at least one designated surface including at least one mobile monitoring and recording module. The at least one mobile monitoring and recording module includes at least one support and stabilization section, at least one erector section, at least one autonomous source of electric energy, at least one electric energy storage device, and at least one control and information storage unit. The at least one support and stabilization section incorporates a transportation subsection arranged to provide mobility when coupled to a source of a mechanical force and at least one stabilizing subsection arranged to stabilize the at least one monitoring and recording module in a stationary traffic monitoring position. The at least one erector section includes an erector arranged to erect at least one speed measuring device, at least one traffic imaging device, at least one traffic light sensor, and at least one illumination device at respective predetermined heights above the designated surface.

BRIEF DESCRIPTION OF THE DRAWINGS

The above and other embodiments, features, and aspects of the present invention are considered in more detail in relation to the following description of embodiments shown in the accompanying drawings, in which.

DETAILED DESCRIPTION OF THE INVENTION

The invention summarized above and defined by the enumerated claims may be better understood by referring to the following description, which should be read in conjunction with the accompanying drawings of particular exemplary embodiments. This description of the illustrated embodiment, set out below to enable one to build and use an implementation of the invention, is not intended to limit the invention, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also understand that such equivalent assemblies do not depart from the spirit and scope of the invention in its broadest form.

Figure 1:
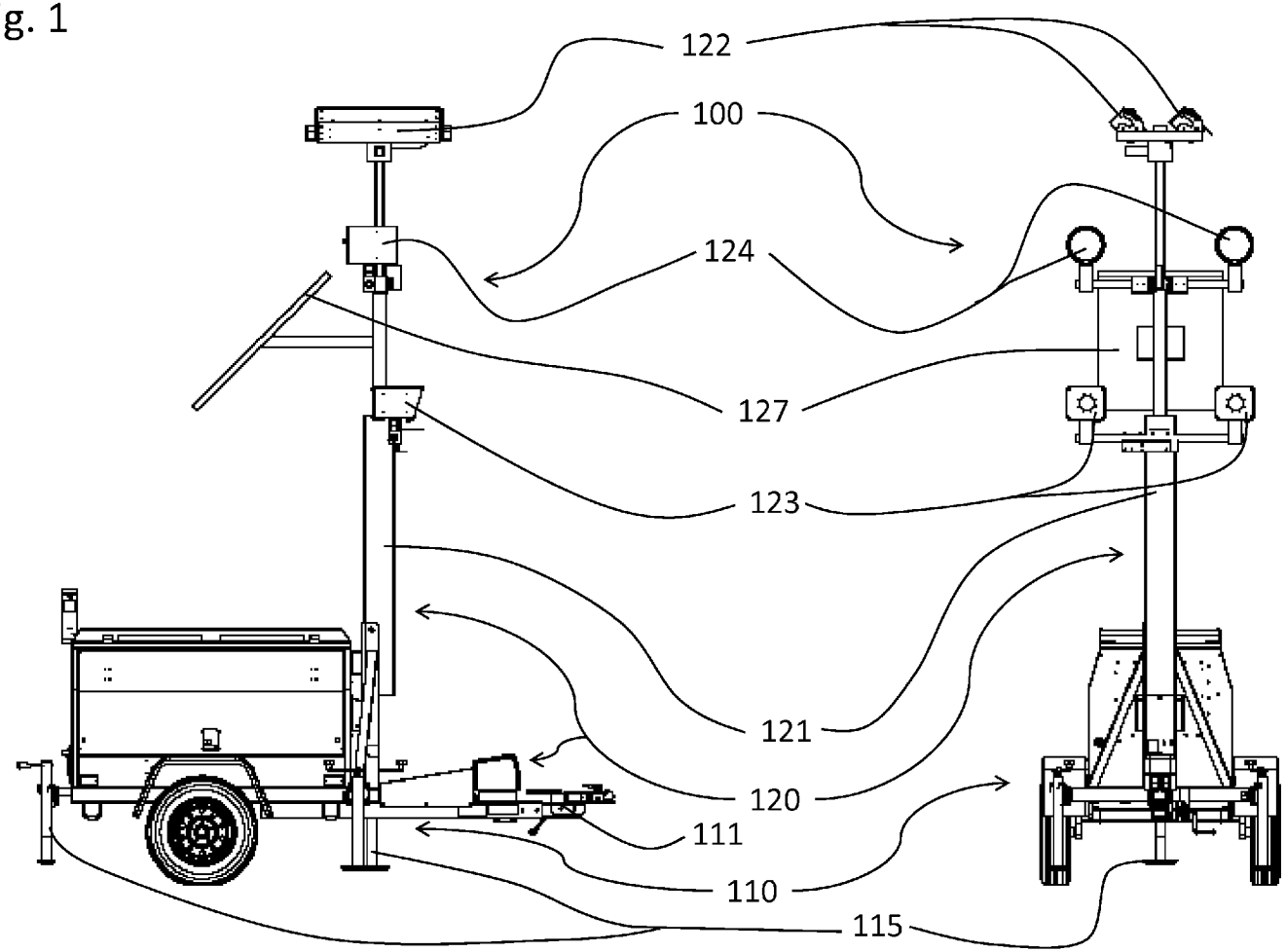
FIG. 1 is an illustration of an exemplary embodiment of the autonomous system according to the present invention.

FIG. 1 illustrates an exemplary embodiment of the autonomous system for automated monitoring of a traffic pattern on at least one designated surface including at least one monitoring and recording module 100, depicted as a front and a side orthogonal projection. The monitoring and recording module 100 incorporates at least one support and stabilization section 110 and at least one erector section 120. The support and stabilization section 110 includes a transportation subsection 111 arranged to provide mobility when coupled to a source of a mechanical force, and at least one stabilization subsection 115 arranged to stabilize the monitoring and recording module 100 in a stationary traffic monitoring position.

The erector section 120 includes an erector 121 arranged to erect at least one speed measuring device 122, at least one traffic imaging device 123, and at least one illumination device 124 to respective predetermined heights relative to a designated surface. The designated surface is arranged to support surface traffic and can include, for example, a surface of a roadway, a surface of a parking lot, a ground traffic supporting surface of an airport, or a traffic supporting surface inside structures exemplified by factory halls, sport arenas, or other structures supporting traffic.

The exemplary embodiment illustrated in FIG. 1 also include a solar panel generator 127 associated with the erector 121 arranged to convert a portion of ambient light into electric energy available for use by the mobile monitoring and recording module 100. In addition, the embodiment illustrated in FIG. 1 also incorporates at least one electric energy storage device (not shown in FIG. 1 but illustrated in FIG. 2 as electric energy storage device 210), at least one autonomous source of electric energy 220 (in the form of a diesel generator in FIG. 2) connected to at least one electric energy storage device 210 (in the form of a lead/acid battery bank in FIG. 2).

Figure 2:
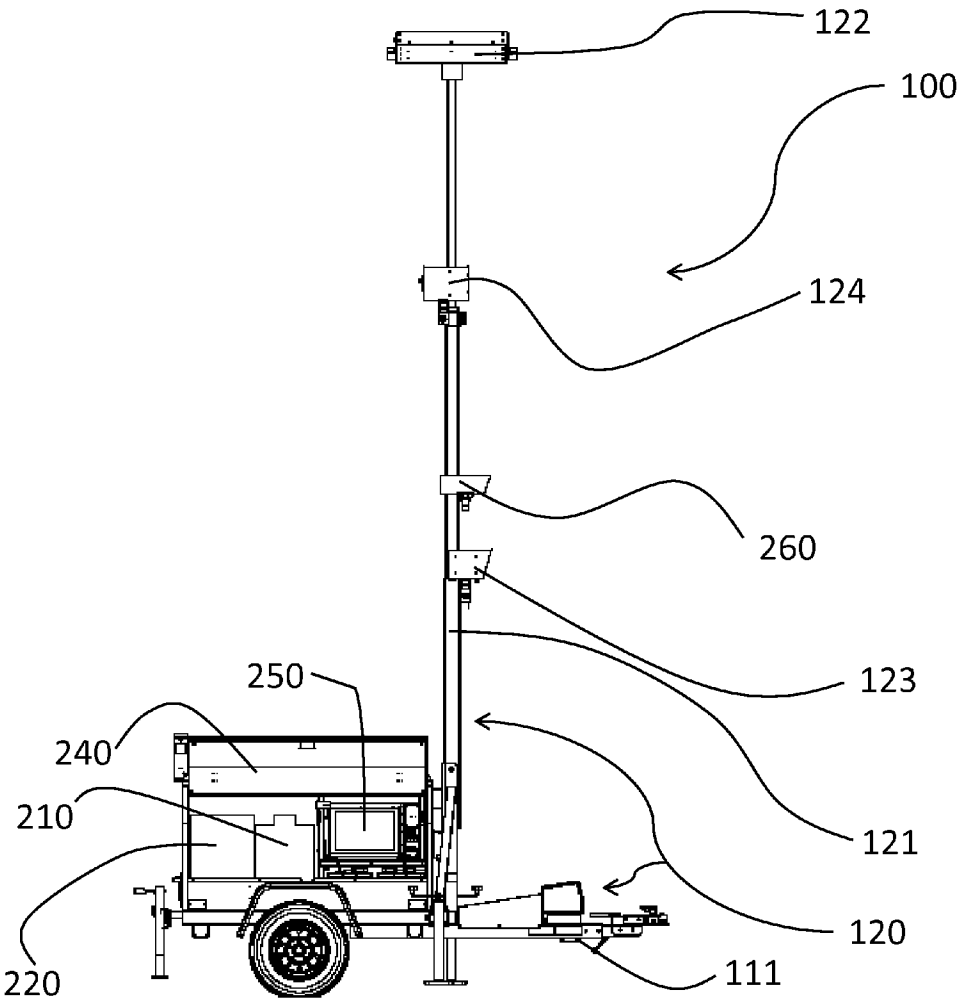
FIG. 2 is an illustration of a different exemplary embodiment of the autonomous system according to the present invention.

A different embodiment from the embodiment illustrated in FIG. 1 is illustrated in a side projection in FIG. 2 having one side panel 240 of the monitoring and recording module 100 fixed in an open position. The side projection in FIG. 2 also illustrates at least one control and information storage unit 250 including a computer and a disk drive arranged and programmed to control functions of the monitoring and recording module 100 and to store predetermined data sets.

One distinction between the embodiment illustrated as an example in FIG. 2 and the embodiment exemplified in the projections in FIG. 1, (in addition to the illustration of the side panel 240 in the open position) is incorporation of at least one traffic light sensor 260 incorporated into the erector section 120 so as to be erectable by the erector 121 to a predetermined height. The traffic light sensor 260 is constructed and arranged in a line of site relative to a traffic light (the traffic light not shown in FIG. 2 but included in the FIG. 3 as the traffic light 380) in order to support red light enforcement related applications.

The speed measuring devices 122 of the exemplary embodiments illustrated in FIGS. 1 and 2 are based on the Sigma Space Corporation proprietary LIDAR elaborated, for example, in U.S. Pat. No. 7,323,987 to Seas et al., entitled "COMPACT SINGLE LENS LASER SYSTEM FOR OBJECTNEHICLE PRESENCE AND SPEED DETERMINATION", and assigned to the Sigma Space Corporation, which is incorporated herein by reference. Similarly, the red light sensor 260 is based on the systems and methods disclosed in U.S. Pat. No. 7,495,579 to Sirota et al., entitled "TRAFFIC LIGHT STATUS REMOTE SENSOR SYSTEM", and assigned to the Sigma Space Corporation, which is incorporated herein by, reference, and the aforementioned copendng and co-owned U.S. patent application Ser. No. 11/118,540, incorporated by reference above. It is to be understood that different speed measuring devices and red light sensors are well known to practitioners. Some of those devices may be used in different embodiments of current invention without exceeding the scope of the current invention.

The exemplary embodiments illustrated in FIGS. 1 and 2 incorporate several commercially available parts and assemblies when practical. More particularly, the embodiments of FIGS. 1 and 2 utilize the transportation subsection 110 and the erector 121 custom made for the Sigma Space Corporation by the Wanco Inc. of Arvada, Colo., such that the mobile monitoring and recording module 100 can be legally transported in traffic as a wheeled trailer towed by a commercial towing vehicle equipped with standardized towing accessories.

The autonomous source of electric energy 210 may utilize an internal combustion engine generator such is a low-noise (less than 90 dB at positions at or separated more than 20 ft from the monitoring and recording module 100) diesel generator available from Yanmar America Corporation of Buffalo Grove, Ill. Other electric generators including solar panel generators, wind-driven generators, direct chemical energy conversion sources of electric energy, fuel cell generators, and combinations of the listed autonomous sources of electric energy may be used in different embodiments of the current invention. The exemplary embodiments in FIGS. 1 and 2 may use YANMAR 3 cylinder diesel motor (such as model #3TNH68-A) to drive a generator coupled to 12V lead/acid battery bank (for example AGM Battery from Magna Power part. No. 8A8D/T904), but other sources and storage mediums of electric energy may be incorporated and used (in alternative or in addition) by average practitioners in accordance with the established engineering practice.

Furthermore, the exemplary embodiments in FIGS. 1 and 2 may incorporate commercial Nikon D200 digital camera (including a version of Nikon D200 commercially modified by Life Pixel Infrared Conversion Services of Mukilteo, Wash., for additional IR sensitivity) as the traffic imaging device 123. Also, the illumination device 124 in FIGS. 1 and 2 may integrate a commercial flash unit modified for IR operation by addition of a visible light blocking filter like B400 flash from AlienBees in conjunction with additional Infrared Pass/Visible Light blocking filter including, for example, the ClearIR 63143 TP acrylic resin marketed under the brand name Plexiglas® by Altuglas International (part of ARKEMA GROUP of Colombes Cedex, France). In addition, the B400 flash unit may be modified by replacing a light bulb (such as the light bulb JDD E27 customarily shipped with commercial B400 flash units) by a passive IR-reflective cone having a height up to 2" and conical half-angle from 10° to 80° as needed for optimization of desired irradiation distributions.

Such an illumination device may be arranged to emit radiation which is substantially undetectable by an unassisted eye of a human observer (with possible exclusion of unlikely attempts to monitor the illumination device head on from an observation point at extreme proximity of the Infrared Pass/Visible Light blocking filter). Therefore, the illumination device 124 may be arranged to minimize light pollution and substantially eliminate disturbances of residents, bystanders, or traffic participants even in the most densely populated urban settings.

In addition, the embodiments illustrated in FIGS. 1 and 2 may be controlled by the control and information storage unit 250 incorporating a Windows-based PC including a hard disk drive. More particularly above embodiments may utilize a scalable small form factor commercial computer like Slimpro SP631 available from CappuccinoPC.com web site by Unicomp Laboratories, Inc. of Brentwood N.Y. It may be noted that a variety of computers capable of supporting control software and storing pertinent data acquired by the sensors of the mobile monitoring and recording module 100 are commercially available from numerous suppliers and may be adapted for use with many embodiments of the current invention.

Figure 3:
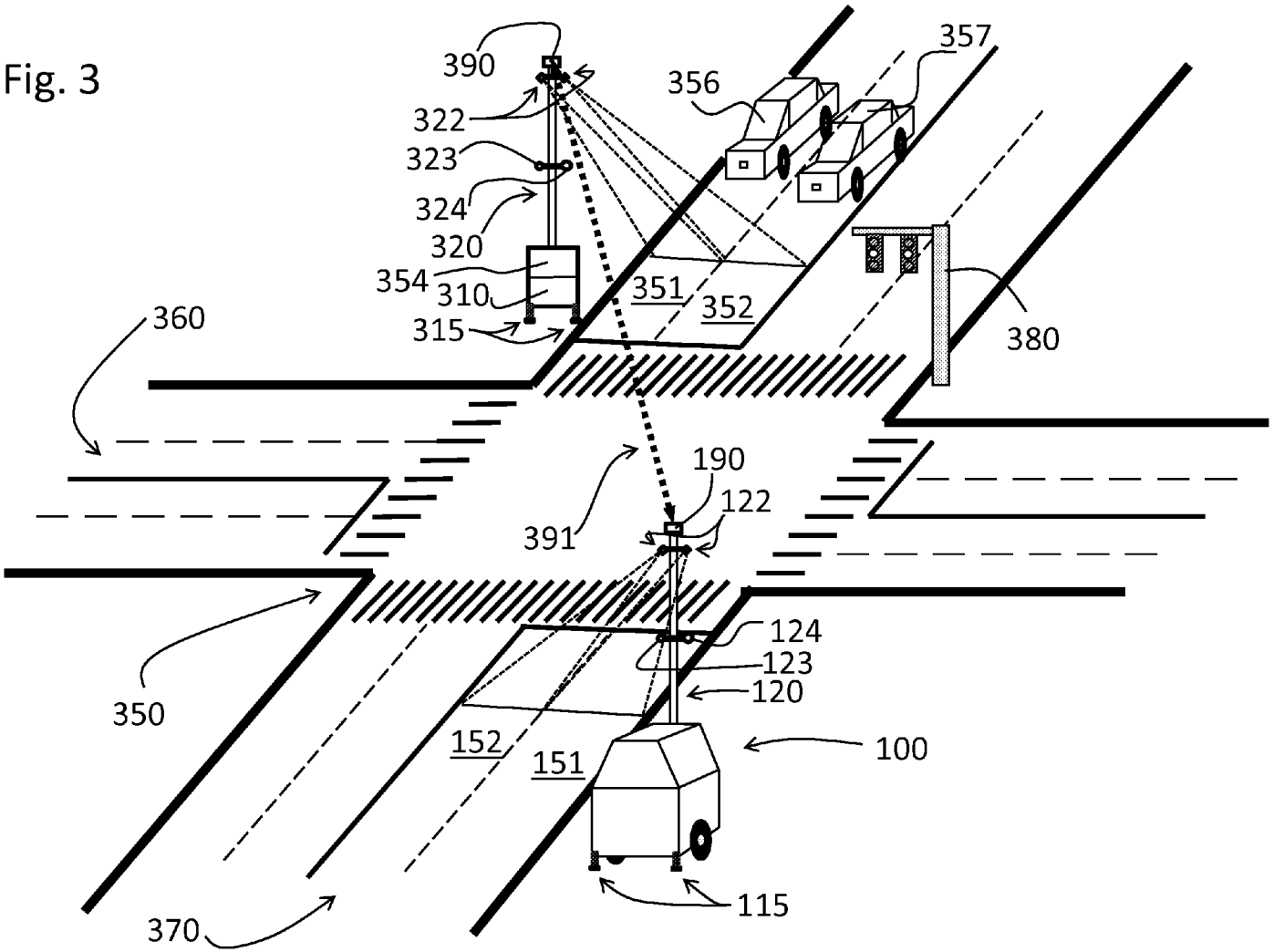
FIG. 3 is an illustration of yet another different exemplary embodiment of the autonomous system according to the present invention.

Another exemplary embodiment of the autonomous system for automated monitoring of a traffic pattern different from embodiments illustrated in FIGS. 1 and 2 is illustrated in FIG. 3. The monitoring and recording module 100 of the embodiment in FIG. 3 incorporates at least one additional erector section 320 similar to the erector section 120. The at least one additional erector section 320 is arranged to be transportable by being attached to and supported by the transportation subsection 111 during transport, but equipped with a dedicated stabilization subsection 315 arranged to stabilize the at least one additional erector section 320 in a traffic monitoring position separated from the position of the erector section 120.

The at least one additional erector section 320 may be arranged, depending on particular embodiment, to erect and support several monitoring and imaging devices. In the embodiment illustrated in FIG. 3, the at least one additional erector section 320 supports additional speed measuring devices 322 arranged to monitor traffic approaching an intersection 350 of two multiple lane road ways 360 and 370, supported by at least two traffic lanes 351 and 352 representing the designated surfaces. Also, the at least one additional erector section 320 may support an IR flash representing an illumination device 324 similar to the illumination device 124, and a visible/IR traffic imaging device 323 similar to the traffic imaging device 123.

The erector section 120 and the at least one additional erector section 320 may be arranged remotely so that any function of the erector sections 120 does not obstruct any function of the additional erector section 320 and vice versa. Furthermore, in the embodiment exemplified by the system illustrated in FIG. 3, the erector section 120 and the additional erector section 320 each supports a communication devices 190 and 390 arranged for a line of sight communication between the erector section 120 and the additional erector section 320, for example via a laser beam link 391. It may be noted that other customary devices for wireless communication can also be used in different embodiments without exceeding the scope of the current invention.

One may note that the speed measuring devices 122 (322) of the embodiment illustrated in FIG. 3 exhibit sufficient spatial resolution to distinguish between two or more vehicles 356 and 357 simultaneously present in proximity to each other for example in traffic lanes 351 and 352, and sufficiently accurately determine the speed of each participating vehicle regardless of the relative positions or directions of vehicles 357 and 357 motions relative to the center of the intersection 350.

The at least one additional erector section 320 may include an additional electric energy generator 310 and an additional control and information storage unit 354 for control and data management, or may be connected to and utilize the control and information storage unit 250, for example via a laser beam link 391.

The intersection 350 illustrated in FIG. 3 is controlled by a traffic light 380. Consequently, the embodiment represented by the example illustrated in FIG. 2 can be also implemented to monitor the traffic through the intersection 350. In addition, this embodiment may be used for red light enforcement using the information on the status of the traffic light 380 detected by a red light sensor (not shown in FIG. 3) similar to the red light sensor 260 as illustrated in FIG. 2.

Figure 4:
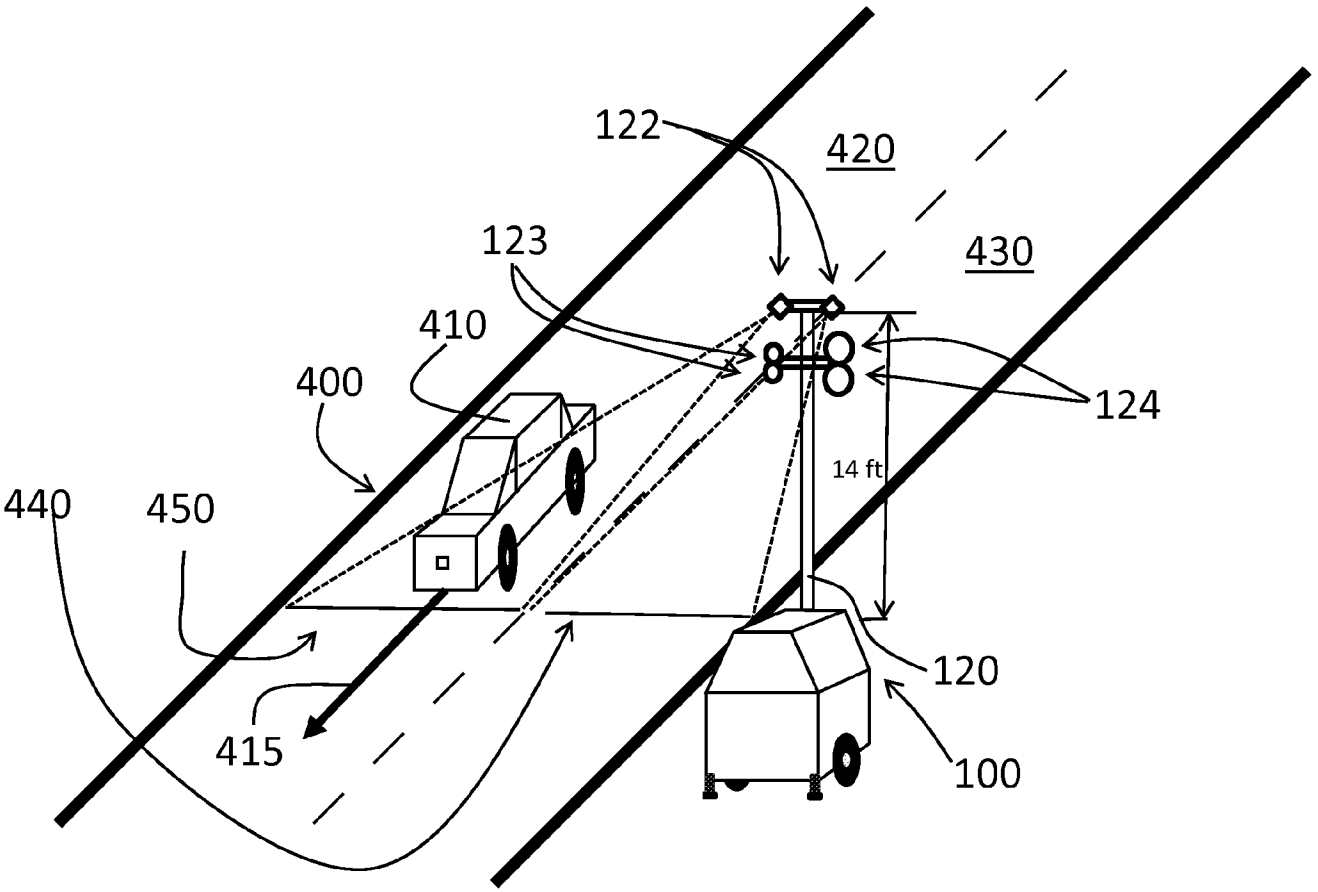
FIG. 4 is an illustration of an additional exemplary embodiment of the autonomous system according to the present invention.

An example of an additional embodiment of the mobile monitoring and recording module 100 in accordance with the current invention arranged for monitoring a traffic pattern on a two-way road 400 having two traffic lanes 410 and 420 which support traffic in opposite directions (two-way) is illustrated in FIG. 4. In the illustrated example, the traffic supported by the traffic lane 420 is exemplified by a vehicle 410. The monitoring and recording module 100 in FIG. 4 includes the erector section 120 arranged to erect the speed monitoring devices 122. As evident by inspection of FIG. 4, it is preferable that the speed measuring devices 122 can observe elongated observation area 450 or the presence of the vehicle 410 intersecting at least in part the elongated observation area 450 even when the proximal traffic lane 430 may be occupied by a vehicle (not shown in FIG. 4) as large as a truck. Noting that public transportation vehicles customarily do not exceed the 14 ft height limit of a minimal overpass height in urban areas, it may be concluded that a predetermined height over the surfaces of two-way road 400 of 14 ft or more may be sufficient to ensure an adequate observation clearance for the speed measuring devices 122 over the customary traffic participants.

Figure 5:
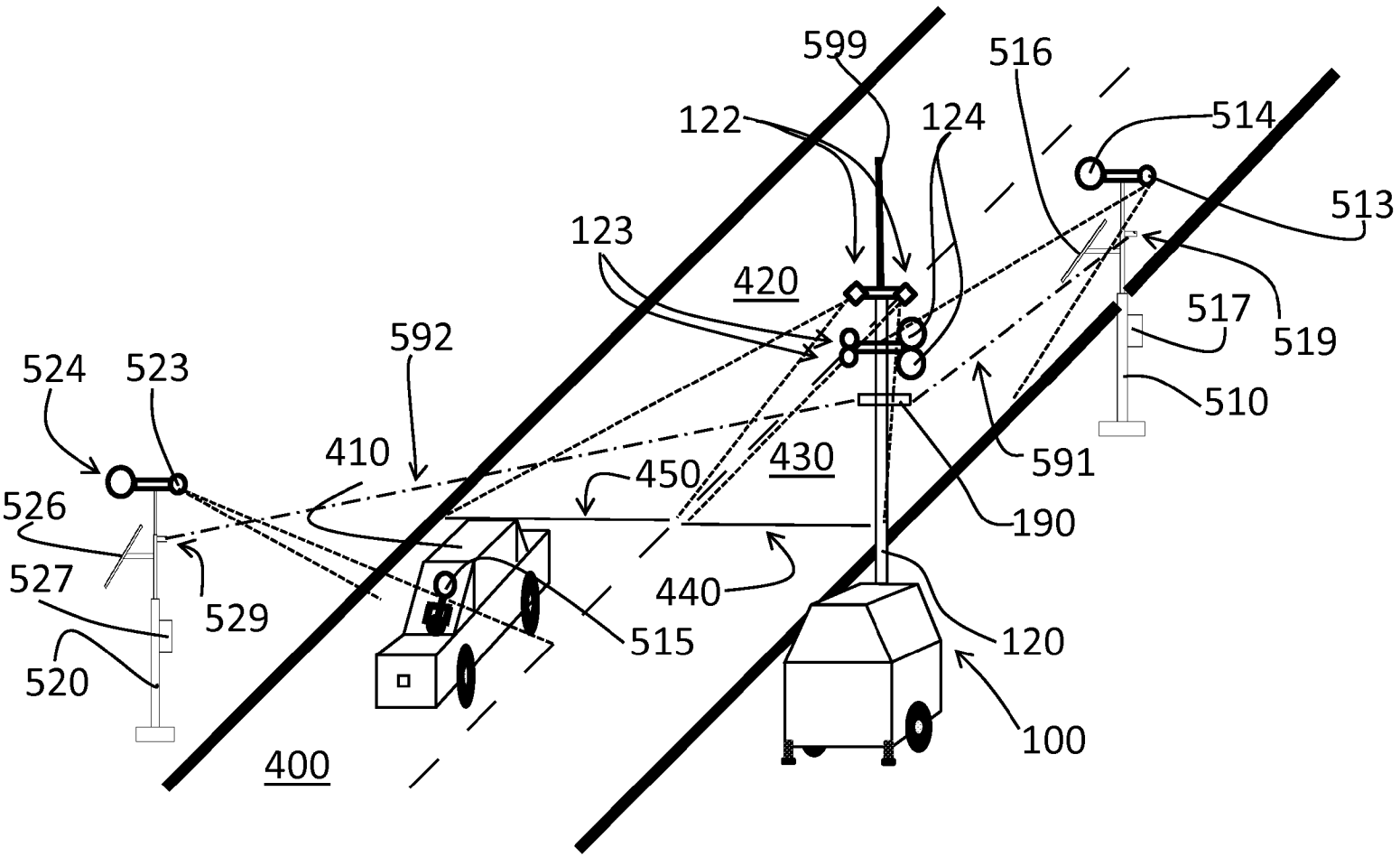
FIG. 5 is an illustration of a different additional exemplary embodiment of the autonomous system according to the present invention.

An example of yet another additional embodiment of the mobile monitoring and recording module 100 in accordance with the current invention arranged for monitoring a traffic pattern on a two-way road 400 having two traffic lanes 410 and 420 which support traffic in opposite directions is illustrated in FIG. 5. In the illustrated example, the traffic supported by the traffic lane 420 is exemplified by a vehicle 410 controlled by an operator 515. The exemplary monitoring and recording module 100 in FIG. 5 includes the erector section 120 arranged to erect the speed monitoring devices 122, and two auxiliary erector sections 510 and 520 arranged to erect auxiliary traffic imaging devices 513 and 523 and auxiliary illumination devices 514 and 524. The auxiliary erector sections 510 and 520 may be transported attacked to the transportation subsection 111 or (in different embodiments) may be transported separately from the module 100.

In addition, in the exemplary embodiment illustrated in FIG. 5, the auxiliary erector section 520 (510) includes a solar panel generator 526 (516) and an auxiliary energy storage device 527 (517) in the form of a rechargeable battery pack. The auxiliary erector section 520 (510) also includes the communication device 190 represented in the illustrated embodiment by a directional microwave communication device 529 (519) arranged to communicate with the erector section 120 via microwave beam 592 (591).

The auxiliary erector sections 510 and 520 of the exemplary embodiment illustrated in FIG. 5 may be arranged respectively downstream in the direction of traffic supported by the traffic lanes 420 and 430 relative to the elongated observation areas 440 and 450 such that the traffic imaging devices 513 and 523 may record at least one uniquely identifiable feature of the vehicle operator 515 after triggering by over the speed limit speed measurements from the speed measuring devices 122. This feature of positive identification of the offending vehicle operators 515 of the illustrated exemplary embodiment allows for traffic laws violation citations enforceable against individual vehicle operators 515 independent from the need of the positive identification of the offending vehicles exemplified by the vehicle 410.

It may be noted that a different embodiment including the auxiliary erector sections similar to the auxiliary erector sections 510 and 520 illustrated in FIG. 5 may be arranged to incorporate at least one traffic light sensor similar to the sensors 260 in FIG. 2. Therefore, the traffic imaging devices 123, 513, and 523 of these embodiments may be arranged to record at least one uniquely identifiable feature of the vehicle operator 515 after passing through an intersection in violation of the red light signal 380.

Furthermore, it may be deduced from observations of FIGS. 1-5 and disclosures in the U.S. Pat. No. 7,323,987 to Seas et al. and the copendng and co-owned U.S. patent application Ser. No. 11/118,540 to Sirota et al., both incorporated above by reference, that the autonomous system for automated monitoring a traffic pattern in accordance with the current invention measures vehicle speeds substantially at positions defined by the elongated observation areas 440 and 450 and is not sensitive to measurements errors and uncertainties ("cosine errors" and "cosine corrections") customarily associated with a time-varying angle between the observed vehicle velocity and the direction along which the observed vehicle is detected by a road-side speed measuring devices of prior art.

Finally, all exemplary embodiments illustrated in FIGS. 1-5 are designed and constructed to include into the control and information storage unit 250 in subsystem for clock calibration against a virtually ubiquitous clock signal of a Global Positioning System (GPS) satellite system, receivable for example by a GPS antenna 599, for time calibration.

The present invention has been described with references to the exemplary embodiments arranged for different applications. While specific values, relationships, materials and components have been set forth for purposes of describing concepts of the invention, it will be appreciated by persons skilled in the art that numerous variations and/or modifications may be made to the invention as shown in the specific embodiments without departing from the spirit or scope of the basic concepts and operating principles of the invention as broadly described. It should be recognized that, in the light of the above teachings, those skilled in the art can modify those specifics without departing from the invention taught herein. Having now fully set forth the preferred embodiments and certain modifications of the concept underlying the present invention, various other embodiments as well as certain variations and modifications of the embodiments herein shown and described will obviously occur to those skilled in the art upon becoming familiar with such underlying concept. It is intended to include all such modifications, alternatives and other embodiments insofar as they come within the scope of the appended claims or equivalents thereof. It should be understood, therefore, that the invention may be practiced otherwise than as specifically set forth herein. Consequently, the present embodiments are to be considered in all respects as illustrative and not restrictive.

We claim:

1. An autonomous system for automated monitoring of traffic patterns on at least one designated surface comprising:

at least one mobile monitoring and recording module including;

at least one support and stabilization section;

at least one erector section;

at least one autonomous source of electric energy;

at least one electric energy storage device; and at least one control and information storage unit;

wherein the at least one support and stabilization section includes a transportation subsection arranged to provide mobility when coupled to a source of a mechanical force, at least one stabilizing subsection arranged to stabilize the at least one mobile monitoring and recording module in a stationary traffic monitoring position;

wherein the autonomous system for automated monitoring of traffic patterns is arranged to have no wired connections or no dedicated data conduits between the autonomous system for automated monitoring of traffic patterns and a traffic control signaling device;

wherein the at least one erector section includes an erector arranged to erect at least one speed measuring device, at least one traffic imaging device, and at least one illumination device at respective predetermined heights above the designated surface;

and wherein the at least one designated surface includes a surface of a roadway, the surface of the roadway is a two-way road surface, and the erector is arranged to position the at least one speed measuring device at a height equal to or exceeding 14 feet so that the at least one speed measuring device is arranged to measure speed in either direction of the two-way road without implementation of a cosine effect correction.

2. The autonomous system for automated monitoring of traffic patterns of claim 1, wherein the transportation subsection includes a wheeled trailer arranged to transport the at least one erector section.

3. The autonomous system for automated monitoring of traffic patterns of claim 2, wherein the wheeled trailer is arranged to be towed by a towing vehicle.

4. The autonomous system for automated monitoring of traffic patterns of claim 1, wherein at least two erector sections are arranged to monitor the traffic patterns supported by at least two separate portions of the at least one designated surface so that any function of any one of the erector sections does not obstruct any function of any other erector section.

5. The autonomous system for automated monitoring of traffic patterns of claim 4, wherein the at least two erector sections are connected to a common control and information storage unit.

6. The autonomous system for automated monitoring of traffic patterns of claim 5, wherein a connection between the at least one erector section and the common control and information storage unit is a wireless connection.

7. The autonomous system for automated monitoring of traffic patterns of claim 6, wherein the wireless connection is a laser beam link connection or a microwave beam link connection.

8. The autonomous system for automated monitoring of traffic patterns of claim 4, wherein each one of the at least two erector sections includes one dedicated control and information storage unit of at least two dedicated control and information storage units.

9. The autonomous system for automated monitoring of traffic patterns of claim 1, wherein the at least one traffic imaging device is a camera sensitive to a light in a visible and in an infrared (IR) range of frequencies, and at least one illumination device is an infrared (IR) illumination device.

10. The autonomous system for automated monitoring of traffic patterns of claim 9, wherein the infrared (IR) illumination device is an infrared (IR) flash arranged for a negligible residential and traffic disturbance by radiating visible light substantially undetectable by an unassisted eye of a human observer.

11. The autonomous system for automated monitoring of traffic patterns of claim 1, wherein the at least one autonomous source of electric energy is chosen from a group consisting of internal combustion engine generators, solar panel generators, wind-driven generators, direct chemical energy conversion sources of electric energy, fuel cell generators, and combinations of the listed autonomous sources of electric energy.

12. The autonomous system for automated monitoring of traffic patterns of claim 11, wherein the at least one autonomous source of electric energy includes at least one solar panel.

13. The autonomous system for automated monitoring of traffic patterns of claim 12, wherein the at least one solar panel is associated with the at least one erector section.

14. The autonomous system for automated monitoring of traffic patterns of claim 11 wherein, no part of the autonomous system for automated monitoring of traffic patterns is positioned on any of at least one designated surface, no wired connections are established between the autonomous system for automated monitoring of traffic patterns and either one of local power distribution systems, local traffic control system, and local water and sewer system, and no modification is performed on either one of local power distribution systems, local traffic control system, and local water and sewer system.

15. The autonomous system for automated monitoring of traffic patterns of claim 1, wherein the at least one autonomous source of electric energy includes a generator arranged such that a generator's noise intensity at a position separated by 20 ft. or more from the generator does not exceed 90 dB.

16. The autonomous system for automated monitoring of traffic patterns of claim 1, wherein the at least one designated surface is a multiple lane roadway and the at least one mobile autonomous monitoring and recording module is arranged for a simultaneous uni-directional or bi-directional monitoring of at least two lanes of the multiple lane roadway.

17. The autonomous system for automated monitoring of traffic patterns of claim 1, comprising an onboard clock and a subsystem for clock calibration against a transmitted clock signal of a Global Positioning System (GPS) satellite system.

18. The autonomous system for automated monitoring of traffic patterns of claim 1 wherein, the at least one traffic imaging device is arranged to record at least one uniquely identifiable feature of a vehicle operator after violating a speed limit as measured by the at least one speed measuring device.

19. An autonomous system for automated monitoring of traffic patterns on at least one designated surface comprising:

at least one mobile monitoring and recording module including;
at least one support and stabilization section;
at least one erector section;
at least one autonomous source of electric energy;
at least one electric energy storage device; and
at least one control and information storage unit;

wherein the at least one support and stabilization section includes a transportation subsection arranged to provide mobility when coupled to a source of a mechanical force, at least one stabilizing subsection arranged to stabilize the at least one mobile monitoring and recording module in a stationary traffic monitoring position;

wherein the autonomous system for automated monitoring of traffic patterns is arranged to have no wired connections or no dedicated data conduits between the autonomous system for automated monitoring of traffic patterns and a traffic control signaling device;

wherein the at least one erector section includes an erector arranged to erect at least one speed measuring device, at least one traffic imaging device, and at least one illumination device at respective predetermined heights above the designated surface, and wherein at least one designated surface includes at least two adjacent traffic lanes and the at least two speed measuring devices are arranged to simultaneously measure speeds of at least two separate vehicles traveling in the at least two adjacent traffic lanes.

20. An autonomous system for automated monitoring of traffic patterns, speed measuring, and red light enforcement on at least one designated surface comprising:

at least one mobile monitoring and recording module including:
at least one support and stabilization section;
at least one erector section;
at least one autonomous source of electric energy;
at least one electric energy storage device; and
at least one control and information storage unit;

wherein the at least one support and stabilization section includes a transportation subsection arranged to provide mobility when coupled to a source of a mechanical force, at least one stabilizing subsection arranged to stabilize the at least one mobile monitoring and recording module in a stationary traffic monitoring position;

wherein the autonomous system for automated monitoring of traffic patterns is arranged to have no wired connections or no dedicated data conduits between the autonomous system for automated monitoring of traffic patterns and a traffic control signaling device;

wherein the at least one erector section includes an erector arranged to erect at least one speed measuring device, at least one traffic imaging device, at least one traffic light sensor, and at least one illumination device at a predetermined height above the designated surface; and wherein the at least one designated surface includes a surface of a roadway, the surface of the roadway is a two-way road surface and the erector is arranged to position the at least one speed measuring device at a height equal to or exceeding 14 feet so that the at least one speed measuring device is arranged to measure speed in either direction the two-way road without implementation of a cosine effect correction.

21. The autonomous system for automated monitoring of traffic patterns, speed measuring, and red light enforcement of claim 20, wherein the transportation subsection includes a wheeled trailer arranged to transport the at least one erector section.

22. The autonomous system for automated for monitoring of traffic patterns, speed measuring, and red light enforcement of claim 21, wherein the wheeled trailer is arranged to be towed by a towing vehicle.

23. The autonomous system for automated monitoring of traffic patterns, speed measuring, and red light enforcement claim 20, wherein at least two erector sections are arranged to monitor the traffic patterns supported by at least two separate portions of the at least one designated surface so that any function of any one of the erector sections does not obstruct any function of any other erector section.

24. The autonomous system for automated monitoring of traffic patterns, speed measuring, and red light enforcement of claim 23, wherein the at least two erector sections are connected to a common control and information storage unit.

25. The autonomous system for automated monitoring of traffic patterns, speed measuring, and red light enforcement of claim 24, wherein a connection between the at least one erector section and the common control and information storage unit is a wireless connection.

26. The autonomous system for automated monitoring of traffic patterns, speed measuring, and red light enforcement of claim 25, wherein the wireless connection is a laser beam link or a microwave beam link connection.

27. The autonomous system for automated monitoring of traffic patterns, speed measuring, and red light enforcement of claim 23, wherein each one of the at least two erector sections includes one dedicated control and information storage unit of at least two dedicated control and information storage units.

28. The autonomous system for automated monitoring of traffic patterns, speed measuring, and red light enforcement of claim 20, wherein the at least one traffic imaging device is a camera sensitive to a light in a visible and in an infrared (IR) range of frequencies, and at least one illumination device is an infrared (IR) illumination device.

29. The autonomous system for automated of traffic patterns, speed measuring, and red light enforcement of claim 28, wherein the infrared (IR) illumination device is an infrared (IR) flash arranged for a negligible residential and traffic disturbance by radiating visible light substantially undetectable by an unassisted eye of a human observer.

30. The autonomous system for automated monitoring of traffic patterns, speed measuring, and red light enforcement of claim 20, wherein the at least one autonomous source of electric energy is chosen from a group consisting of internal combustion engine generators, solar panel generators, wind-driven generators, direct chemical energy conversion sources of electric energy, fuel cell generators, and combinations of the listed autonomous sources of electric energy.

31. The autonomous system for automated monitoring of traffic patterns, speed measuring, and red light enforcement of claim 30, wherein the at least one autonomous source of electric energy includes at least one solar panel.

32. The autonomous system for automated monitoring of traffic patterns, speed measuring, and red light enforcement of claim 31, wherein the at least one solar panel is associated with the at least one erector section.

33. The autonomous system for automated monitoring of traffic patterns, speed measuring, and red light enforcement of claim 30 wherein, no part of the system for monitoring of traffic patterns, speed measuring and red light enforcement is positioned on any of at least one designated surface, no wired connections are established between the system for monitoring of traffic patterns, speed measuring and red light enforcement and either one of local power distribution systems, local traffic control system, or local water and sewer system, and no modification is performed on either one of local power distribution systems, local traffic control system, or local water and sewer system.

34. The autonomous system for automated monitoring of traffic patterns, speed measuring, and red light enforcement of claim 20, wherein the at least one autonomous source of electric energy includes a generator arranged such that generator's noise intensity at a position separated by 20 ft. or more from the generator does not exceed 90 dB.

35. The autonomous system for automated monitoring of traffic patterns, speed measuring, and red light enforcement of claim 20, wherein the at least one designated surface is a multiple lane roadway and the at least one mobile autonomous monitoring and recording module is arranged for a simultaneous uni-directional or bi-directional monitoring of at least two lanes of the multiple lane roadway.

36. The autonomous system for automated monitoring of traffic patterns, speed measuring, and red light enforcement of claim 20, comprising an onboard clock and a subsystem for clock calibration against a transmitted clock signal of a Global Positioning System (GPS) satellite system.

37. autonomous system for automated monitoring of traffic patterns, speed measuring, and red light enforcement of claim 20 wherein, the at least one traffic imaging device is arranged to record at least one uniquely identifiable feature of a vehicle operator after violating a traffic light status as detected by the at least one traffic light sensor.

38. An autonomous system for automated monitoring of traffic patterns, speed measuring and red light enforcement on at least one designated surface comprising:

at least one mobile monitoring and recording module including;

at least one support and stabilization section;

at least one erector section;

at least one autonomous source of electric energy;

at least one electric energy storage device; and at least one control and information storage unit;

wherein the at least one support and stabilization section includes a transportation subsection arranged to provide mobility when coupled to a source of a mechanical force, at least one stabilizing subsection arranged to stabilize the at least one mobile monitoring and recording module in a stationary traffic monitoring position;

wherein autonomous system for automated monitoring of traffic patterns is arranged to have no wired connections or no dedicated data conduits between the autonomous system for automated monitoring of traffic patterns and a traffic control signaling device;

wherein the at least one erector section includes an erector arranged to erect at least one speed measuring device, at least one traffic imaging device, at least one traffic light sensor, and at least one illumination device at a predetermined height above the designated surface, and wherein the at least one designated surface includes at least two adjacent traffic lines and the at least two speed measuring devices are arranged to simultaneously measure speeds of at least two separate vehicles traveling in the at least two adjacent traffic lanes.

* * * * *